US006651596B1

(12) United States Patent
Wittchow

(10) Patent No.: US 6,651,596 B1
(45) Date of Patent: Nov. 25, 2003

(54) CONTINOUS FLOW STEAM GENERATOR HAVING A DOUBLE-FLUE CONSTRUCTION

(75) Inventor: Eberhard Wittchow, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/436,597

(22) Filed: Nov. 9, 1999

Related U.S. Application Data

(63) Continuation of application No. PCT/DE98/01167, filed on Apr. 27, 1998.

(30) Foreign Application Priority Data

May 9, 1997 (DE) ..... 197 19 724

(51) Int. Cl.[7] ..... F22G 3/00
(52) U.S. Cl. ..... 122/467; 122/1 B; 122/406.4
(58) Field of Search ..... 122/1 B, 406.4, 122/451 S, 479.7, 448.4, 467

(56) References Cited

U.S. PATENT DOCUMENTS 2,252,061 A * 8/1941 Cassidy ..... 122/332
3,174,464 A 3/1965 Johnson
3,288,117 A 11/1966 Schroedter
3,289,645 A 12/1966 Evans
3,927,646 A * 12/1975 Dungey et al. ..... 122/6 A
4,428,329 A * 1/1984 Rees ..... 122/510
5,501,181 A * 3/1996 Phelps, Sr. ..... 122/510
5,934,227 A * 8/1999 Phelps ..... 122/235.12

* cited by examiner

*Primary Examiner*—Gregory Wilson
(74) *Attorney, Agent, or Firm*—Herbert L. Lerner; Laurence A. Greenberg; Werner H. Stemer

(57) ABSTRACT

A continuous flow steam generator with a double-flue construction has a vertical gas flue with an ascending conduction of fuel gas. The combustion chamber rear wall is inclined inwards and towards the combustion chamber in an upper part region and thereby forms, with the bottom of an adjoining horizontal gas flue, a nose which projects into the combustion chamber. Some steam generator tubes of the lower part region of the combustion chamber rear wall are led upwards, uninclined, as supports for the combustion chamber rear wall, as far as a supporting structure located outside the conduction of the fuel gas.

5 Claims, 4 Drawing Sheets

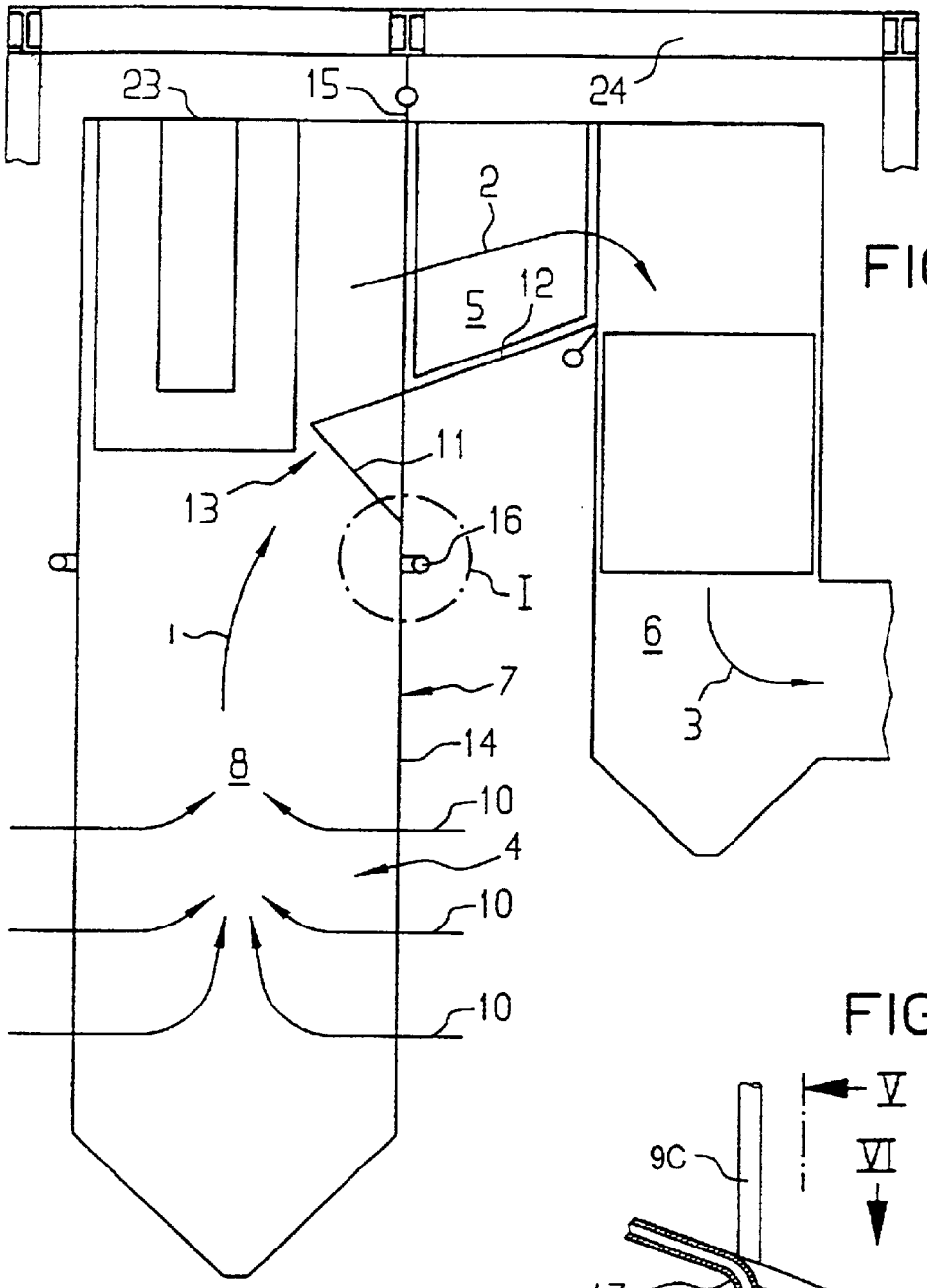
FIG 1
FIG 4
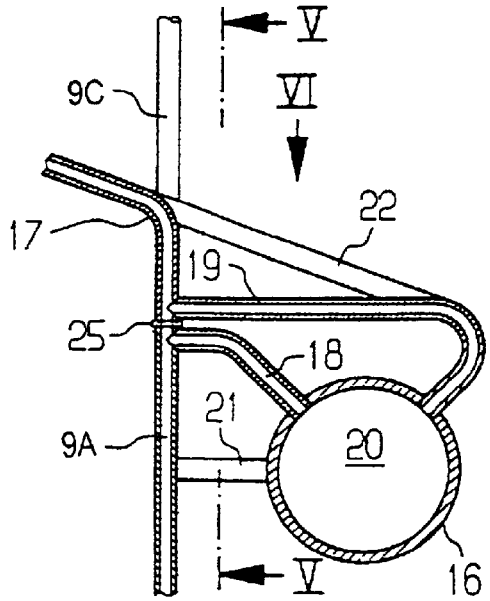

9C
9C
22
9C
22
17
22
V
11
IV
19
16
V
IV
18
21

CONTINOUS FLOW STEAM GENERATOR HAVING A DOUBLE-FLUE CONSTRUCTION

CROSS-REFERENCE TO RELATED APPLICATION

This application is a continuation of copending International Application No. PCT/DE98/01167, filed Apr. 27, 1998, which designated the United States.

BACKGROUND OF THE INVENTION

1. Field of the Invention

The invention relates to a continuous flow steam generator having a double-flue construction, with a combustion chamber rear wall of a first vertical flue, the rear wall being inclined inwards relative to the combustion chamber in an upper part region thereof and thereby forming with the bottom of an adjoining horizontal gas flue a "nose" which projects into the combustion chamber. Such a nose in the upper part of the combustion chamber rear wall at the transition into the horizontal gas flue improves the conduction of the flue gas.

A continuous flow steam generator of a double-flue construction having such a "nose" is illustrated in FIG. 1 of U.S. Pat. No. 3,174,464. Some of the steam generator tubes in the lower part of the combustion chamber rear wall are guided uninclined up to a supporting structure outside the heating gas conduction and thus serve as a support for the combustion chamber rear wall which has the "nose".

A separate partial heating surface with an inlet header and an outlet header has usually been employed for suspending the combustion chamber rear wall, in order to avoid stability problems and possibly resulting tube fractures in the supporting tubes through which mainly wet steam flows. This suspension structure is highly complicated. Another disadvantage is usually the temperature difference between the supporting tubes, which are combined to form a separate partial heating surface, and the combustion chamber side walls, when the flow does not pass through these heating surfaces in parallel, but, as is customary, in succession. Above all, when a still hot continuous flow steam generator is being filled with colder feed water before the burners are ignited, considerable temperature differences occur between the supporting tubes of the combustion chamber rear wall and the combustion chamber side walls. These temperature differences may damage the tubes as a consequence of inadmissibly high thermal stresses.

SUMMARY OF THE INVENTION

It is accordingly an object of the invention to provide a continuous flow steam generator which overcomes the above-mentioned disadvantages of the heretofore-known steam generators of this general type. In particular it is an object to provide a cost-effective and operationally reliable configuration for supporting or suspending a combustion chamber rear wall, or, in general terms, a cost-effective and operationally reliable way of fixing the combustion chamber rear wall in a supporting structure above a pressure part of the steam generator With the foregoing and other objects in view there is provided, in accordance with the invention, a continuous flow steam generator of a double-flue construction, including:

a horizontal gas flue having a bottom;

a vertical gas flue adjoining the horizontal gas flue and having a combustion chamber and an evaporator heating surface forming a combustion chamber rear wall, the combustion chamber rear wall having a lower part region, an upper part region, and a side facing away from the combustion chamber;

the combustion chamber rear wall being essentially vertically oriented in the lower part region and being directed approximately toward the horizontal gas flue, the vertical gas flue having an ascending conduction of a fuel gas and being connected, with respect to a direction of the conduction of the fuel gas, in series with the horizontal gas flue;

the combustion chamber rear wall having steam generator tubes ascending next to one another, being joined to one another in a gas-tight manner, and being connected in parallel for a flow medium to flow through the steam generator tubes, the steam generator tubes including a plurality of first steam generator tubes and a plurality of second steam generator tubes;

the plurality of first steam generator tubes being inclined inward in the upper part region of the combustion chamber rear wall, toward the combustion chamber, and forming, together with the bottom of the horizontal gas flue, a nose projecting into the combustion chamber;

an approximately horizontally extending balancing header disposed on the side of the combustion chamber rear wall facing away from the combustion chamber;

inlet tubes and respective outlet tubes disposed above the inlet tubes, connecting respective ones of the plurality of first steam generator tubes to the balancing header, the balancing header flow-connecting the plurality of first steam generator tubes beneath the upper part region;

the plurality of second steam generator tubes extending as a support of the combustion chamber rear wall in the lower part region uninclined upwards to a supporting structure located outside the conduction of the fuel gas;

pressure-balancing tubes respectively flow-connecting the plurality of second steam generator tubes to the balancing header; and separating discs respectively provided in the plurality of first steam generator tubes between the inlet tubes and the outlet tubes.

In accordance with another feature of the invention, the balancing header has a crown region. The inlet tubes open into the crown region and the outlet tubes are led away from the crown region.

In accordance with yet another feature of the invention, a separate outlet tube is led out of the balancing header in a region of one of the plurality of second steam generator tubes. The separate outlet tube is led inclined into the upper part region of the combustion chamber rear wall and is parallel with an adjacent one of the plurality of first steam generator tubes.

In accordance with a further feature of the invention, the separate outlet tube is bent such that it can be guided past one of the plurality of second steam generator tubes.

In accordance with the invention, the essential structural elements of the suspension of the combustion chamber rear wall are steam generator tubes through which the flow medium flows and which thus perform a double function. In this case, a part stream of the flow medium flows through the supporting tubes, the part stream being supplied back to the main stream of the flow medium on the other side of the supporting structure in the flow direction.

According to a preferred embodiment, the supporting tubes are distributed uniformly over the extent of the width of the combustion chamber rear wall. Only some, substantially less than half, of the steam generator tubes forming the combustion chamber rear wall are required for the supporting function according to the invention.

According to a further embodiment of the invention, all the steam generator tubes leading to the inclined part region of the combustion chamber rear wall run or open out, below the inclined part region of the combustion chamber rear wall, into the balancing header extending approximately horizontally or that side of the rear wall which faces away from the combustion chamber. However, the steam generator tubes used according to the invention as supporting tubes are flow-connected to the balancing header only by pressure-equalizing tubes. This balancing header, by virtue of a pressure balancing, causes a uniform flow distribution within the combustion chamber rear wall as well as in the tubes of the upper inclined part region. Moreover, a partial balancing of the enthalpy of the flow medium flowing into the balancing header takes place therein. This enthalpy balancing has a favorable effect on the temperature distribution in the inclined heating surface located downstream in the direction of flow and forming the lower flank of the nose according to the invention.

Other features which are considered as characteristic for the invention are set forth in the appended claims.

Although the invention is illustrated and described herein as embodied in continuous flow steam generator having a double-flue construction, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 1 is a fragmentary, diagrammatic side view of a continuous flow steam generator having a double-flue construction, the following figures focus on the encircled region I of a combustion chamber rear wall of a first vertical gas flue;

FIG. 4 is a vertical cross-sectional view of the balancing header and the transition from the lower part region to the upper inclined part region of the combustion chamber rear wall along the sectional line IV—IV in FIGS. 3 and 5;

DESCRIPTION OF THE PREFERRED EMBODIMENTS

Figure 2:
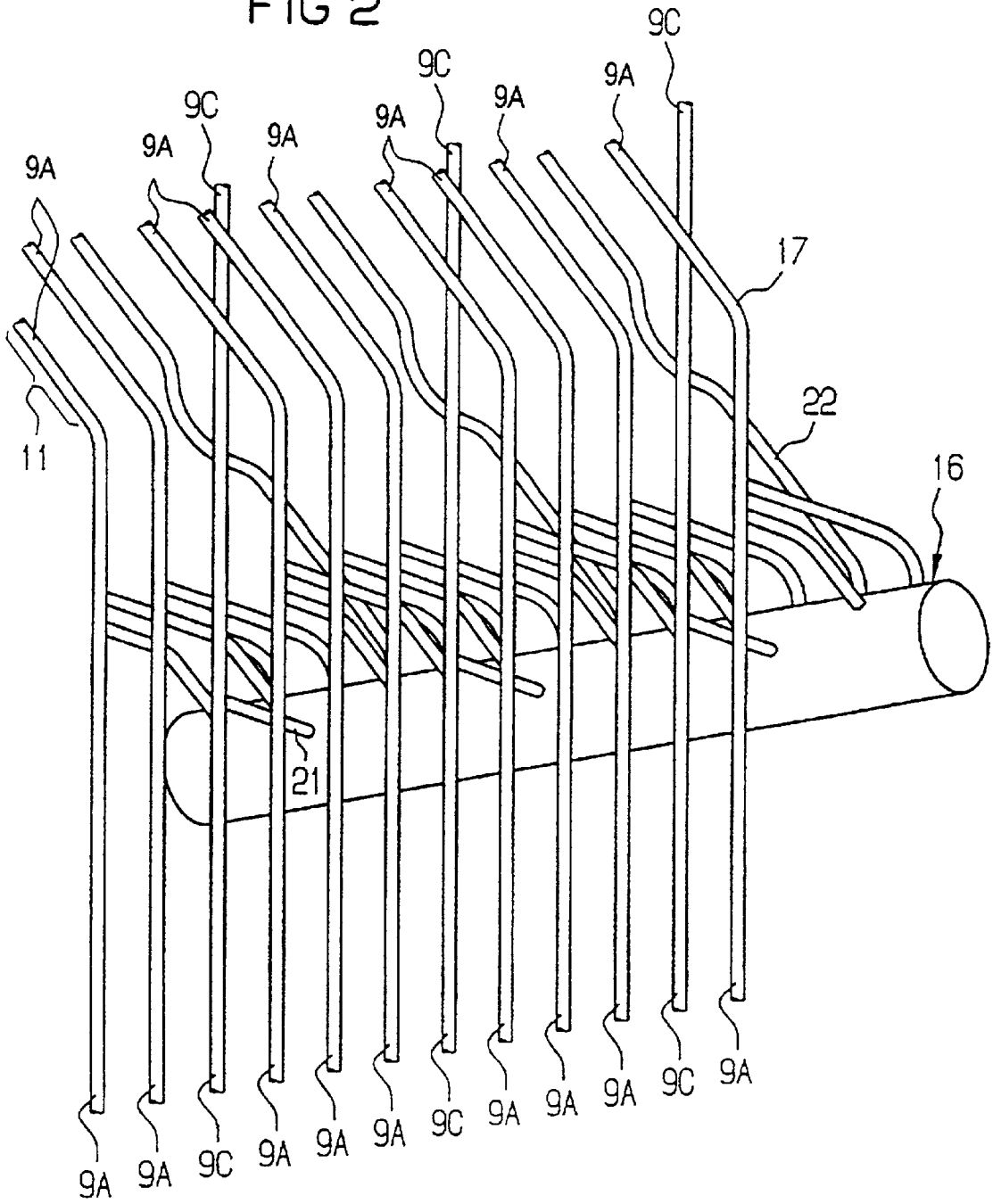
FIG. 2 is a perspective view of a transition from a lower part region of the combustion chamber rear wall to its inclined upper part region, the combustion chamber rear wall is shown looking from the interior of the combustion chamber outwards and without the connecting webs which are provided between the steam generator tubes and welded in a gas-tight manner thereto for conducting the fuel gas.

Referring now to the figures of the drawings in detail and first, particularly, to FIG. 1 thereof, there is shown a continuous flow steam generator according to the invention which has a double-flue construction. This means that a first vertical gas flue 4 with an ascending conduction of fuel gas, a horizontal gas flue 5, and a second vertical gas flue 6 with a descending conduction of fuel gas are provided one after the other in a row and in series in the direction of passage 1 to 3 of the fuel gases. Such a steam generator of double-flue construction has, among other properties not further discussed here, mainly the advantage of a low overall height and compact external dimensions.

Mainly the structural configuration and suspension of the rear wall 7 of the combustion chamber 8 of the first vertical gas flue 4 is of interest here. This rear wall 7 is formed by an evaporator heating surface which is formed essentially of steam generator tubes 9 which ascend next to one another and are connected to one another in a gas-tight manner to form the containing wall and which are connected in parallel for a flow medium to flow through them. These tubes are illustrated in the drawings, with open interspaces included, but, in practice, are closed in a gas-tight manner, which is however not illustrated. They thereby form an impermeable containing wall for the individual gas flues. The combustion chamber rear wall 7 is that containing wall of the first vertical gas flue 4 which faces the second vertical gas flue 6, and is oriented essentially vertically. Fossil fuel is supplied to the combustion chamber 8 from outside through the use of burners 10. During the combustion of the fuel, the fuel gas flowing through the gas flues 4 to 6 is generated.

While the rear wall 7 is oriented approximately vertically in its lower part region 14, in its upper part region 11 it is inclined inwards relative to the interior of the combustion chamber 8. It thereby forms, with the bottom 12 of the adjoining horizontal gas flue 5, a "nose" 13 which projects into the combustion chamber 8. Such a nose 13 serves the purpose of a good conduction or guiding of the flue gas and is a component of the steam generator according to the invention.

In the lower part region 14 of the rear wall 7, the steam generator tubes 9 are of an essentially identical construction and are oriented vertically at uniform parallel distances from one another. However, some steam generator tubes 9, additionally identified by C in the drawings, differ from the remaining steam generator tubes additionally identified by A. These steam generator tubes 9C perform the further function of supporting tubes 9C for the combustion chamber rear wall 7. The steam generator tubes 9C are led, uninclined, upwards as far as an outlet header 15 located outside the conduction of the fuel gas and open into the outlet header there. This outlet header 15 is part of a supporting structure 24. The supporting structure 24 is only fragmentarily illustrated with regard to its structural construction, but is clearly illustrated with regard to the positioning of its steam generator tube 9C which is led out, uninclined, upwards into the region outside the conduction of the fuel gas. The outlet header 15 is located above the boiler ceiling 23. The tubes of the nose 13 merge into the tubes of the bottom 12 of the horizontal gas flue 5 and likewise open into a header. The flow passes in parallel through both tube groups on the water side and the steam side, respectively.

The steam generator tubes 9, which have the additional function of a supporting tube 9C, are distributed uniformly over the combustion chamber rear wall 7. In the exemplary embodiment, about 25% of the steam generator tubes 9 integrated into the combustion chamber rear wall 7 are led upwards, uninclined, as supporting tubes 9C, whereas all the remaining steam generator tubes 9A are bent into the upper inclined part region 11, as can be seen clearly in particular FIGS. 2 and 3.

The steam generator tubes 9 of the lower part region 14 of the combustion chamber rear wall 7 are flow-connected to one another on their side facing away from the combustion chamber 8, below the inclined part region 11, through the use of a balancing header 16 extending approximately horizontally.

The steam generator tubes 9A leading to the inclined part region 11 of the combustion chamber rear wall 7 are flow-connected to the header 16, below their bends 17, in each case through the use of an inlet tube 18 and, above this, an outlet tube 19. In this case, they open into the crown region 20 of the header 16 (inlet tube 18) and are led away from the crown region 20 (outlet tube 19). A can be seen in FIG. 4, a separating disc 25 is located in the steam generator tube 9A between the inlet tube 18 and the outlet tube 19, so that the entire flow medium flows out of the lower part region 14 of the steam generator tube 9A into the header 16.

Figure 3:
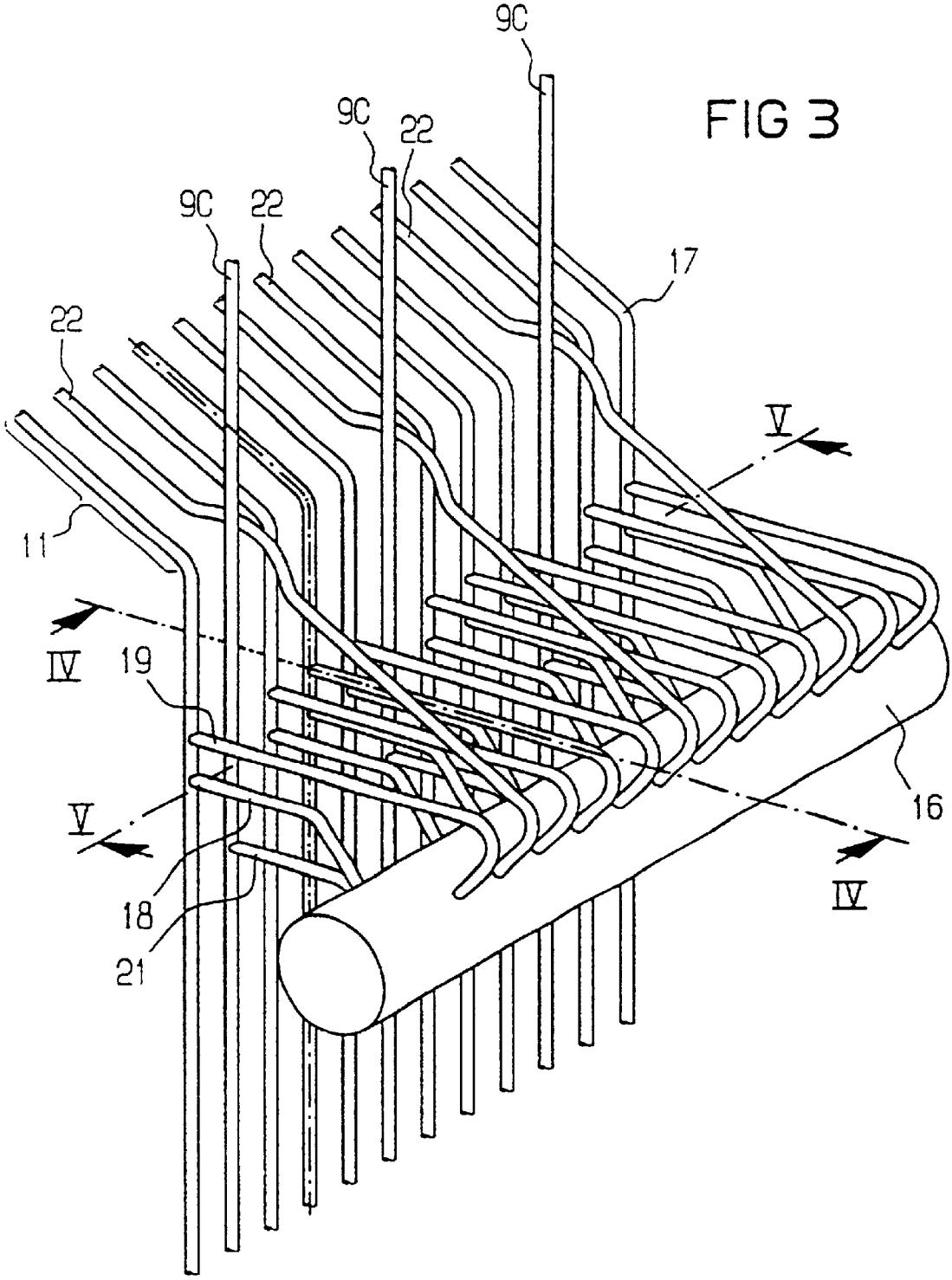
FIG. 3 is a perspective view similar to that of FIG. 2, looking from outside towards the interior of the combustion chamber.

The steam generator tubes 9, used according to the invention as supporting tubes 9C, are spatially connected to the header 16 solely through the use of pressure-balancing tubes 21 which open horizontally approximately into the equatorial region of the clear space of the balancing header 16. The main stream of the flow medium flows, in this case, directly out of a steam generator tube 9 in the lower part region into the supporting tube 9C. In the embodiment illustrated, in the circumferential region of the header 16, specifically in the crown region 20, outlet tubes 22 having the same cross-section as the other tubes are assigned, on the part of the supporting tubes 9C, to the horizontal inlet tubes 21. As can be seen in FIGS. 2 and 3, the outlet tubes are led, inclined, in a straight line into the upper part region 11 of the combustion chamber rear wall 7 and there perform the function of a steam generator tube in the same way as and in addition to other steam generator tubes 9A. The inclined outlet tubes 22 are led past the associated supporting tubes 9C in a bend, such that, in the inclined upper part region 11, the outlet tubes assume, as steam generator tubes, the same spacing position as the supporting tubes 9C in the lower part region 14.

Figure 5:
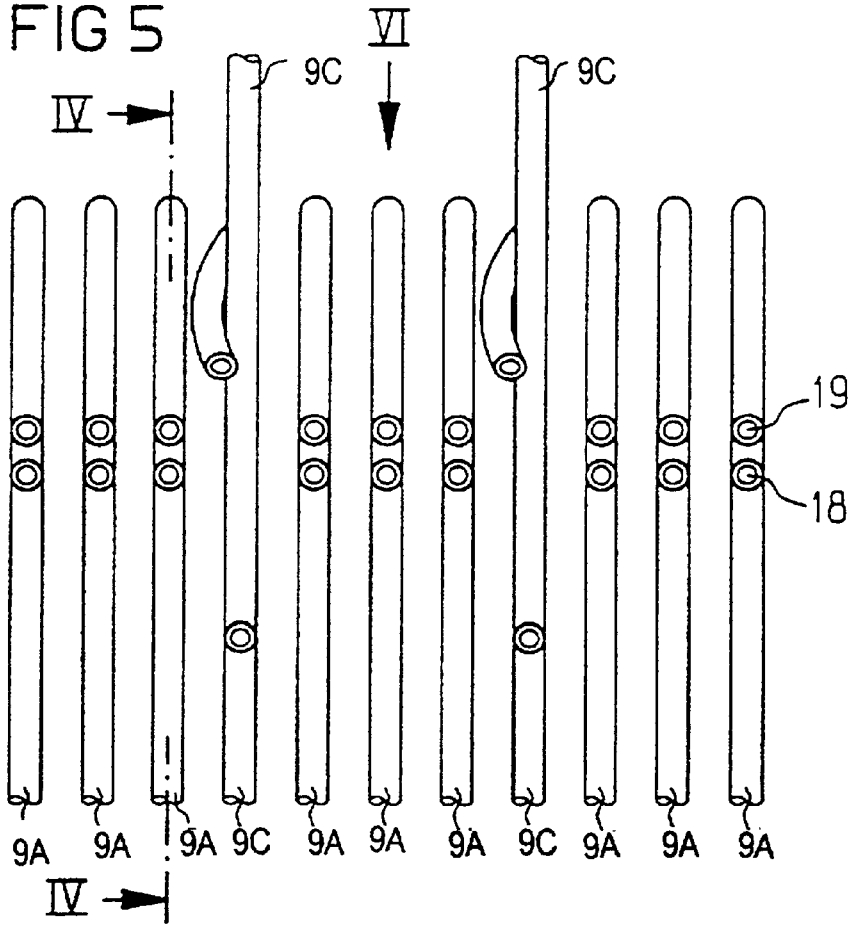
FIG. 5 is a sectional side view of the transition of the lower part region of the combustion chamber rear wall into the upper inclined part region along the sectional line V—V in FIGS. 3 and 4.
Figure 6:
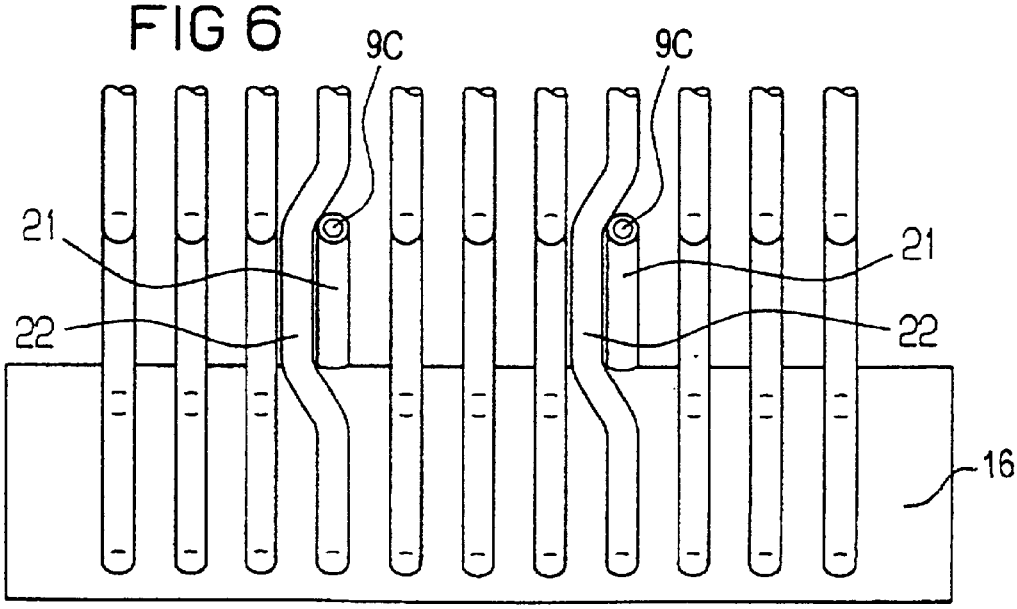
FIG. 6 is a top view of the transition region and of the balancing header in the direction of the arrows VI in FIGS. 4 and 5.

FIG. 5 is a sectional side view illustrating the transition region extending from the lower part region 14 of the combustion chamber rear wall 7 into the upper inclined part region 11. The sectional side view is taken along the sectional line V—V in FIGS. 3 and 4. FIG. 6 is a top view illustrating the transition region and the balancing header 16. The top view is taken in the direction of the arrows VI in FIGS. 4 and 5.

In a further embodiment, not illustrated here, the upper outlet tubes 22 are eliminated as tubes acting as additional steam generator tubes in the inclined upper part region 11. In that case, only the steam generator tubes 9A extending from the lower part region 14 and being inclined via the bends 17 are present as steam generator tubes in the upper inclined part region 11.

I claim:

1. A continuous flow steam generator of a double-flue construction, comprising:

a horizontal gas flue having a bottom;

a vertical gas flue adjoining said horizontal gas flue and having a combustion chamber and an evaporator heating surface forming a combustion chamber rear wall, said combustion chamber rear wall having a lower part region, an upper part region, and a side facing away from said combustion chamber;

said combustion chamber rear wall being essentially vertically oriented in said lower part region and being directed approximately toward said horizontal gas flue, said vertical gas flue having an ascending conduction of a fuel gas and being connected, with respect to a direction of the conduction of the fuel gas, in series with said horizontal gas flue;

said combustion chamber rear wall having steam generator tubes ascending next to one another, being joined to one another in a gas-tight manner, and being connected in parallel for a flow medium to flow through said steam generator tubes, said steam generator tubes including a plurality of first steam generator tubes and a plurality of second steam generator tubes;

said plurality of first steam generator tubes being inclined inward in said upper part region of said combustion chamber rear wall, toward said combustion chamber, and forming, together with said bottom of said horizontal gas flue, a nose projecting into said combustion chamber;

an approximately horizontally extending balancing header disposed on said side of said combustion chamber rear wall facing away from said combustion chamber;

inlet tubes and respective outlet tubes disposed above said inlet tubes, connecting respective ones of said plurality of first steam generator tubes to said balancing header, said balancing header flow-connecting said plurality of first steam generator tubes beneath said upper part region;

said plurality of second steam generator tubes extending as a support of said combustion chamber rear wall in said lower part region uninclined upwards to a supporting structure located outside the conduction of the fuel gas;

pressure-balancing tubes respectively flow-connecting said plurality of second steam generator tubes to said balancing header; and separating discs respectively provided in said plurality of first steam generator tubes between said inlet tubes and said outlet tubes.

2. The steam generator according to claim 1, wherein said combustion chamber rear wall has a width extent and said plurality of second steam generator tubes is distributed essentially uniformly over said width extent.

3. The steam generator according to claim 1, wherein said balancing header has a crown region, said inlet tubes open into said crown region and said outlet tubes are led away from said crown region.

4. The steam generator according to claim 1, including a separate outlet tube led out of said balancing header close to one of said plurality of second steam generator tubes, said separate outlet tube being led inclined into said upper part region of said combustion chamber rear wall and being in parallel with an adjacent one of said plurality of first steam generator tubes.

5. The steam generator according to claim 4, wherein said separate outlet tube is bent to be guided past said one of said plurality of second steam generator tubes.

* * * * *